US010488797B2

(12) United States Patent
Fujii et al.

(10) Patent No.: US 10,488,797 B2
(45) Date of Patent: Nov. 26, 2019

(54) FUSER INCLUDING ENDLESS BELT AND LATERAL GUIDE CONTACTING LATERAL END OF ENDLESS BELT

(71) Applicant: Brother Kogyo Kabushiki Kaisha, Nagoya-shi, Aichi-ken (JP)

(72) Inventors: Yasumasa Fujii, Anjo (JP); Tokifumi Tanaka, Komaki (JP); Hirofumi Kuriki, Nagoya (JP); Masahito Kajita, Nagoya (JP); Kenji Takeuchi, Nagoya (JP); Hiroshi Handa, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/933,488

(22) Filed: Mar. 23, 2018

(65) Prior Publication Data

US 2018/0284666 A1 Oct. 4, 2018

(30) Foreign Application Priority Data

Mar. 28, 2017 (JP) ..... 2017-063375

(51) Int. Cl.
*G03G 15/20* (2006.01)

(52) U.S. Cl.
CPC ..... *G03G 15/2064* (2013.01); *G03G 15/2032* (2013.01); *G03G 15/2053* (2013.01); *G03G 2215/2009* (2013.01); *G03G 2215/2022* (2013.01)

(58) Field of Classification Search
CPC ..... G03G 15/2064; G03G 2215/2022; G03G 2215/2009; G03G 15/206; G03G 15/2053
See application file for complete search history.

(56) References Cited

U.S. PATENT DOCUMENTS

2003/0103788 A1* 6/2003 Yura ..... G03G 15/2064 399/329
2004/0033092 A1 2/2004 Aruga
2008/0292374 A1* 11/2008 Hiraoka ..... G03G 15/206 399/328
2014/0099147 A1* 4/2014 Murakami ..... G03G 15/2053 399/329

FOREIGN PATENT DOCUMENTS

JP 2004-012736 A 1/2004
JP 2004045780 A * 2/2004
JP 2011118440 A * 6/2011
JP 2013-041183 A 2/2013
JP 2013-134439 A 7/2013

* cited by examiner

*Primary Examiner* — Thomas S Giampaolo, II
(74) *Attorney, Agent, or Firm* — Banner & Witcoff, Ltd.

(57) ABSTRACT

There is provided a fuser including: a cylindrical member; an endless belt; a pressing member; a pressing roller; and a lateral guide contacting a lateral end of the endless belt. A part of an outer circumferential surface of the pressing roller is located on a downstream of the second nip area in a first direction. A guide surface of the lateral guide has: a first guide surface located on an opposite side to the pressing roller with respect to a virtual plane including the center of a first nip area and the center of rotation of the cylindrical member, and a second guide surface located on a side of the pressing roller with respect to the virtual plane, located on the downstream side of the rotation axis of the pressing roller in the first direction, and arranged on a same plane as the first guide surface.

16 Claims, 8 Drawing Sheets

FUSER INCLUDING ENDLESS BELT AND LATERAL GUIDE CONTACTING LATERAL END OF ENDLESS BELT

CROSS REFERENCE TO RELATED APPLICATION

The present application claims priority from Japanese Patent Application No. 2017-063375 filed on Mar. 28, 2017 the disclosure of which is incorporated herein by reference in its entirety.

BACKGROUND

Field of the Invention

The present disclosure relates to a fuser (fixing apparatus) which is configured to thermally fuse a developer image transferred to a recording medium.

Description of the Related Art

Conventionally, a fuser is disclosed wherein two pressing members are arranged in the inside of an endless belt, and a nip portion is formed with the two pressing members. For example, in a publicly-known fuser, a nip portion is formed between a heating roller which is arranged on the outside of an endless belt and a pressing roller and a tension member which are arranged in the inside of the endless belt. Further, in this technique, the tension member has a guide surface supporting the inner circumferential surface of the endless belt, and a projection which projects from the guide surface and which has a belt regulating surface contactable with an end surface of the endless belt. With this, it is possible to regulate (restrict), by the belt regulating surface of the projection, any movement of the endless belt in the direction of width thereof.

SUMMARY

According to an aspect of the present teaching, there is provided a fuser including: a cylindrical member; an endless belt including an outer circumferential surface contacting the cylindrical member; a pressing member contacting an inner circumferential surface of the endless belt and sandwiching the endless belt together with the cylindrical member so as to form a first nip area; a pressing roller contacting the inner circumferential surface of the endless belt and sandwiching the endless belt together with the cylindrical member so as to form a second nip area; and a lateral guide including a guide surface contacting a lateral end of the endless belt. A part of an outer circumferential surface of the pressing roller is located on a downstream of the second nip area in a first direction. The first direction is perpendicular to a rotation axis of the pressing roller and directs from a center of the first nip area toward a center of rotation of the cylindrical member. The guide surface includes a first guide surface and a second guide surface. The first guide surface is located such that a virtual plane is located between the pressing roller and the first guide surface, the virtual plane including the center of the first nip area and the center of rotation of the cylindrical member. The second guide surface is located such that the virtual plane is located between the second guide surface and the first guide surface. The second guide surface is located on a downstream of the rotation axis of the pressing roller in the first direction. The second guide surface is arranged on a same plane as the first guide surface.

DESCRIPTION OF THE EMBODIMENTS

Figure 1:
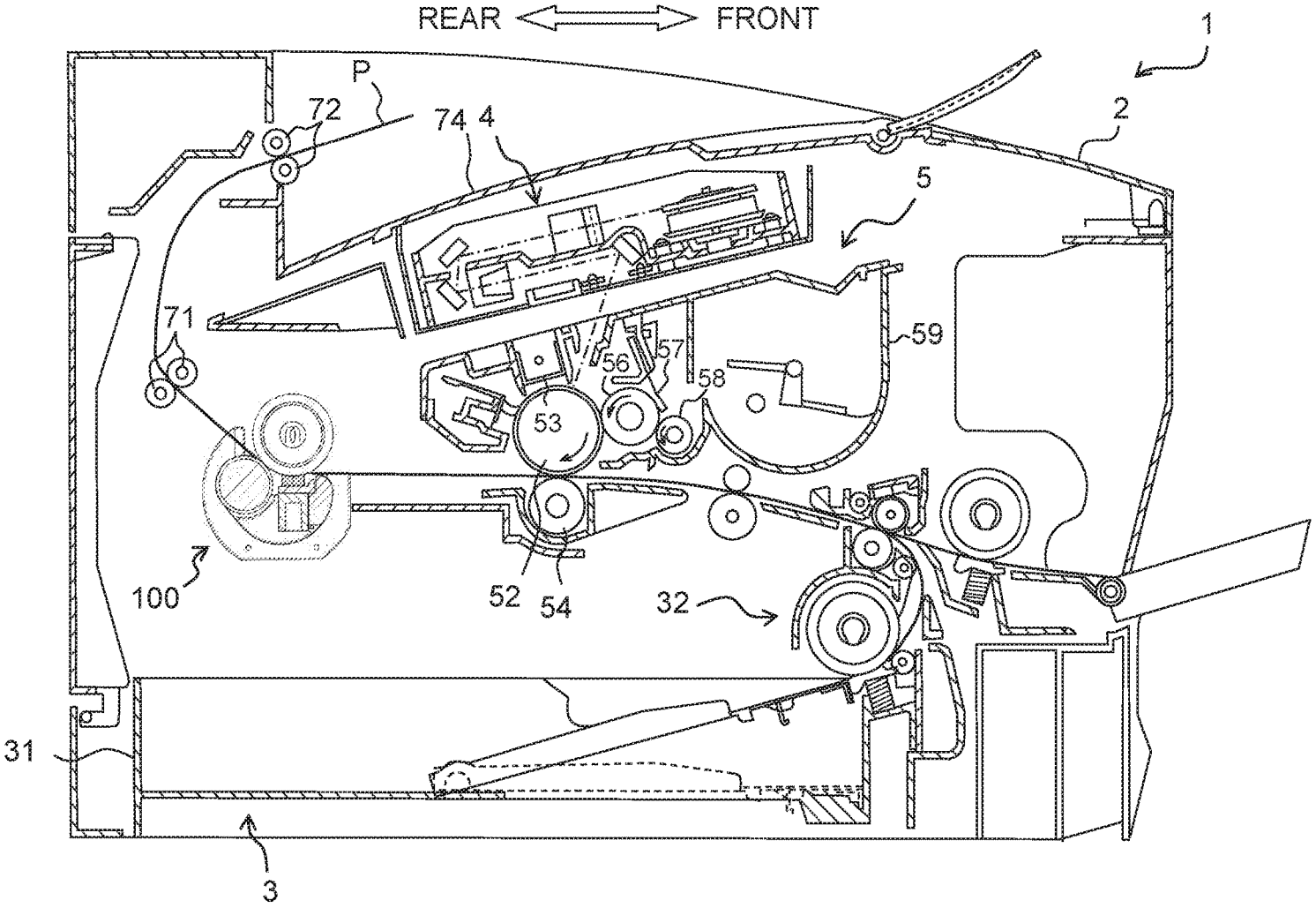
FIG. 1 is a view depicting a laser printer provided with a fuser according to an embodiment of the present teaching.

In the following, an embodiment of the present teaching will be explained, with reference to the drawings as appropriate. In the following explanation, the directions will be explained with directions as depicted in FIG. 1. Namely, in FIG. 1, the right side of the sheet surface of FIG. 1 is defined as "front side", the left side of the sheet surface is defined as "rear side", the far side beyond the sheet surface is defined as "right side", and the front side with respect to the sheet surface is defined as "left side". Note that the up-down direction in the sheet surface is defined as "up-down direction".

As depicted in FIG. 1, a laser printer 1 mainly includes, in the inside of a casing 2 of the main body thereof (body casing 2), a sheet feeding section 3, an exposure apparatus 4, a process cartridge 5 configured to transfer a toner image on a paper sheet P (sheet P), and a fuser (fixing apparatus) 100 configured to thermally fuse (thermally fix) the toner image on the sheet P.

The sheet feeding section 3 is provided with a sheet feeding tray 31 which is installed attachably/detachbly with respect to a lower part of the body casing 2, and a sheet feeding mechanism 32 configured to feed a paper sheet (sheet) in the inside of the sheet feeding tray 31 toward the process cartridge 5.

The exposure apparatus 4 is provided on an upper part in the inside of the body casing 2. The exposure apparatus 4 is provided with a laser emitting section, a polygon mirror, a lens, a reflecting mirror, and the like. A laser beam emitted from the laser emitting section is irradiated onto a surface of a photosensitive drum 52 of the process cartridge 5, via the polygon mirror, etc., while being subjected to a high-speed scanning.

The process cartridge 5 is provided at a location below the exposure apparatus 4 such that the process cartridge 5 is attachable/detachable with respect to the body casing 2. This process cartridge 5 is provided with a photosensitive drum 52, a charger 53, a transferring roller 54, a developing roller 56, a layer-thickness regulating blade 57, a supplying roller 58, and a toner accommodating section 59. The toner inside the toner accommodating section 59 is supplied to the developing roller 56 by the rotation of the supplying roller 58. The toner on the developing roller 56 is regulated to have a predetermined thickness by the layer-thickness regulating blade 57.

In the processing cartridge 5 having such a configuration, the surface of the photosensitive drum 52 is uniformly and positively charged by the charger 53, and then the surface of the photosensitive drum 52 is exposed by the laser beam, from the exposure apparatus 4, which is subjected to the high-speed scanning. With this, an electrostatic latent image is formed on the surface of the photosensitive drum 52.

Next, the toner on the developing roller 56 is supplied to the electrostatic latent image on the surface of the photosensitive drum 52, and a toner image is formed on the surface the photosensitive drum 52. Then, by conveying a sheet P between the photosensitive drum 52 and the transferring roller 54, the toner image on the surface of the photosensitive drum 52 is transferred on the sheet P.

The fuser 100 is provided on the rear side with respect to the process cartridge 5 (on the downstream side in a conveying direction of the sheet P), and thermally fuses, onto the sheet P, the toner image which has been transferred onto the sheet P. Note that the fuser 100 will be descried in detail later on.

Sheet discharging rollers 71 and 72 configured to discharge, to the outside of the body casing 2, the sheet P conveyed from the fuser 100 are provided on the downstream side, in the conveyance direction of the sheet P, with respect to the fuser 100. The sheet P discharged from the fuser 100 is discharged onto a sheet discharge tray 74 by the sheet discharging rollers 71 and 72.

Figure 2:
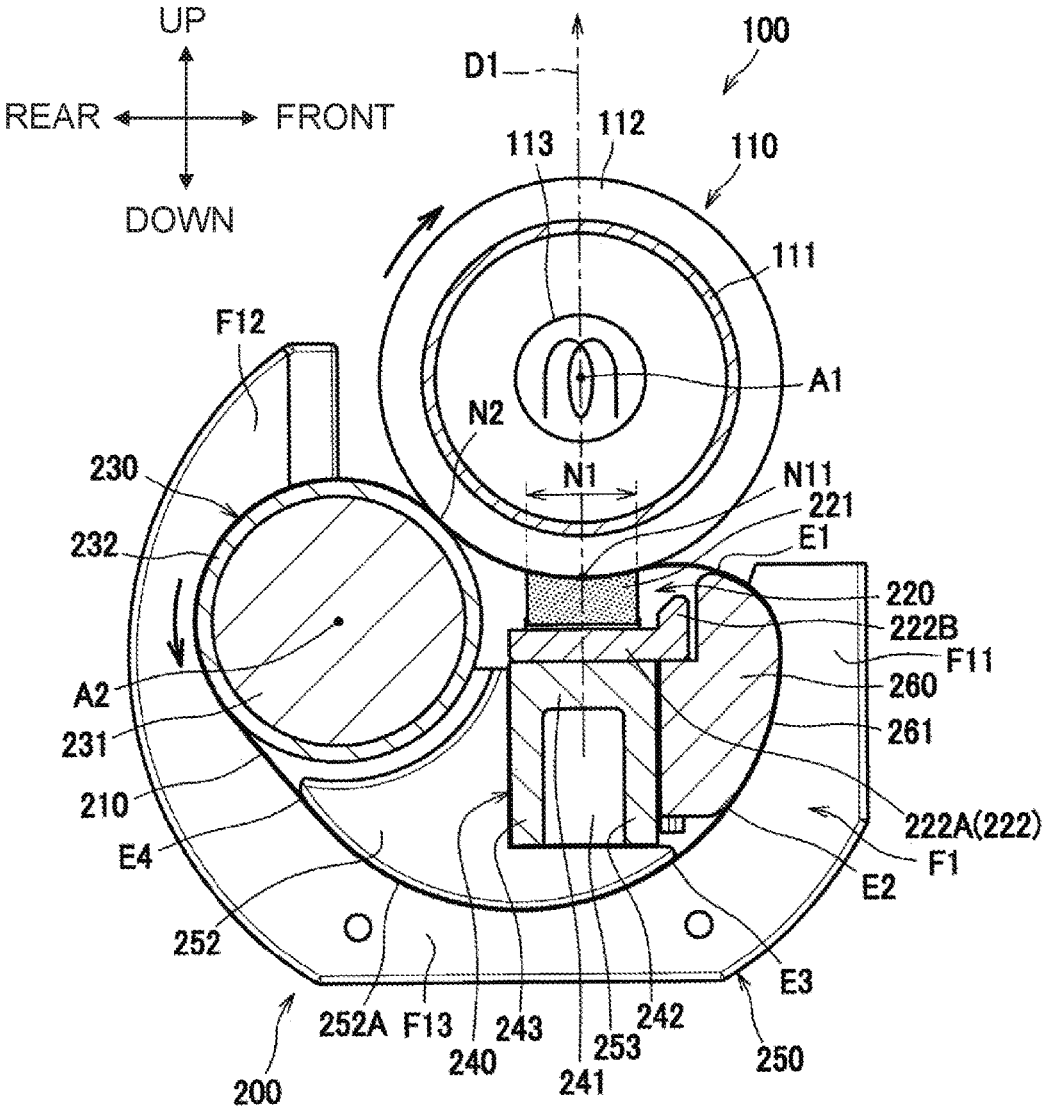
FIG. 2 is a view depicting the fuser.

As depicted in FIG. 2, the fuser 100 is provided with a heating roller 110 as an example of a cylindrical member, and a pressure unit 200.

The heating roller 100 is a roller configured to rotate about an axis of rotation (rotation axis) along the left-right direction. The heating roller 100 is provided with a cylindrical-shaped element tube 111 formed of a metal, and an elastic layer 112 provided on the outer circumferential surface of the element tube 111. The elastic layer 112 is formed of an elastically deformable material such as silicone rubber. A heater 113 is provided in the inside of the element tube 111.

The pressure unit 200 is located at a position below the heating roller 110. The pressure unit 200 is provided with an endless belt 210, a pressing pad 220 as an example of a pressing member, a pressing roller 230, a supporting rod 240, a lateral guide 250, and a guide member 260.

The endless belt 210 is a belt which has a heat-resisting property and a flexibility, and which is heated by the heating roller 110. The outer circumferential surface of the endless belt 210 makes contact with the heating roller 110. In a case that the heating roller 110 is rotated in a state that the heating roller 110 is frictionally engaged with the endless belt 210, the endless belt 210 is rotated following the rotation of the heating roller 110.

The pressing pad 220 is arranged within the width of the heating roller 110 in the front-rear direction, specifically, in the vicinity of a center of rotation A1 of the heating roller 110. The pressing pad 220 is provided with a pad body 221 formed of an elastically deformable member such as silicone rubber, and a holder 222 configured to support the pad body 221.

The pad body 221 makes contact with the inner circumferential surface of the endless belt 210, and sandwiches the endless belt 210 between the pad body 221 and the heating roller 110 so as to form a nip area N1. The pad body 221 is formed to have a rectangular parallelepiped shape elongated in the left-right direction. The pad body 221 is configured to be softer than the elastic layer 112 of the heating roller 110, namely to be elastically deformable with ease. The pad body 221 is fixed to the upper surface of the holder 222.

The holder 222 is formed, for example, of a resin, and has a base part 222A which supports the pad body 221 from therebelow, and a projection 222B which projects upwardly from a front end portion of the base part 222A. The base part 222A and the projection 222B are each formed to have a plate-shape elongated in the left-right direction. The base part 222A is fixed to the upper surface of the supporting rod 240. An upper end portion of the projection 222B is located at a position below the upper surface of the pad body 221.

The supporting rod 240 is formed, for example, of a metal, and is formed to have a cross section which is U-shaped and supports the pressing pad 220 from therebelow. The supporting rod 240 has an upper wall part 241, a front wall part 242 extending downwardly from a front end portion of the upper wall part 241, and a rear wall part 243 extending downwardly from a rear end portion of the upper wall part 241. Each of the wall parts 241 to 243 is formed to have a plate-shape elongated in the left-right direction. The guide member 260 is fixed to a front surface of the front wall part 242.

The guide member 260 is a member configured to guide the inner circumferential surface of the endless belt 210, and is formed, for example, of a resin. The guide member 260 has an inner circumferential guide surface 261 which makes contact with the inner circumferential surface of the endless belt 210. An end portion E1 which is an end portion, of the inner circumferential guide surface 261, on the downstream side in the rotating direction of the endless belt 210 is located at a position in front of (on the front side of) the holder 222 and behind (on the rear side of) a front end portion of the heating roller 110.

Further, the end portion E1 is located at a position above an upper end portion of the projection 222B of the holder 222. Specifically, in the up-down direction, the end portion E1 is located at a position substantially same as a lower end portion of the heating roller 110. An end portion E2 which is an end portion, of the inner circumferential guide surface 261, on the upstream side in the rotating direction of the endless belt 210 is located, in the up-down direction, at a position more closely to the lower surface of the supporting rod 240, rather than to the upper surface of the supporting rod 240. Further, the end portion E2 is located at a position in front of the supporting rod 240.

The pressing roller 230 is located behind the pressing pad 220. The pressing roller 230 is provided with a shaft part 231 formed, for example, of a metal, and a roller part 232 which covers the outer circumferential surface of the shaft part 231. The roller part 232 is formed, for example, of an elastically deformable material such as silicone rubber. The roller part 232 makes contact with the inner circumferential surface of the endless belt 210, and sandwiches the endless belt 210 between the heating roller 110 and the roller part 232 so as to form a nip area N2.

A part or portion of the outer circumferential surface of the roller part 232 is located at a position above the nip area N2. In other words, the part or portion of the outer circumferential surface of the pressing roller 230 is located on the downstream side of the nip area N2 in a direction D1 which is perpendicular to a rotation axis A2 of the pressing roller 230 and which is a direction from a center N11 of the nip area N1 toward the center of rotation of the heating roller 110.

Figure 3:
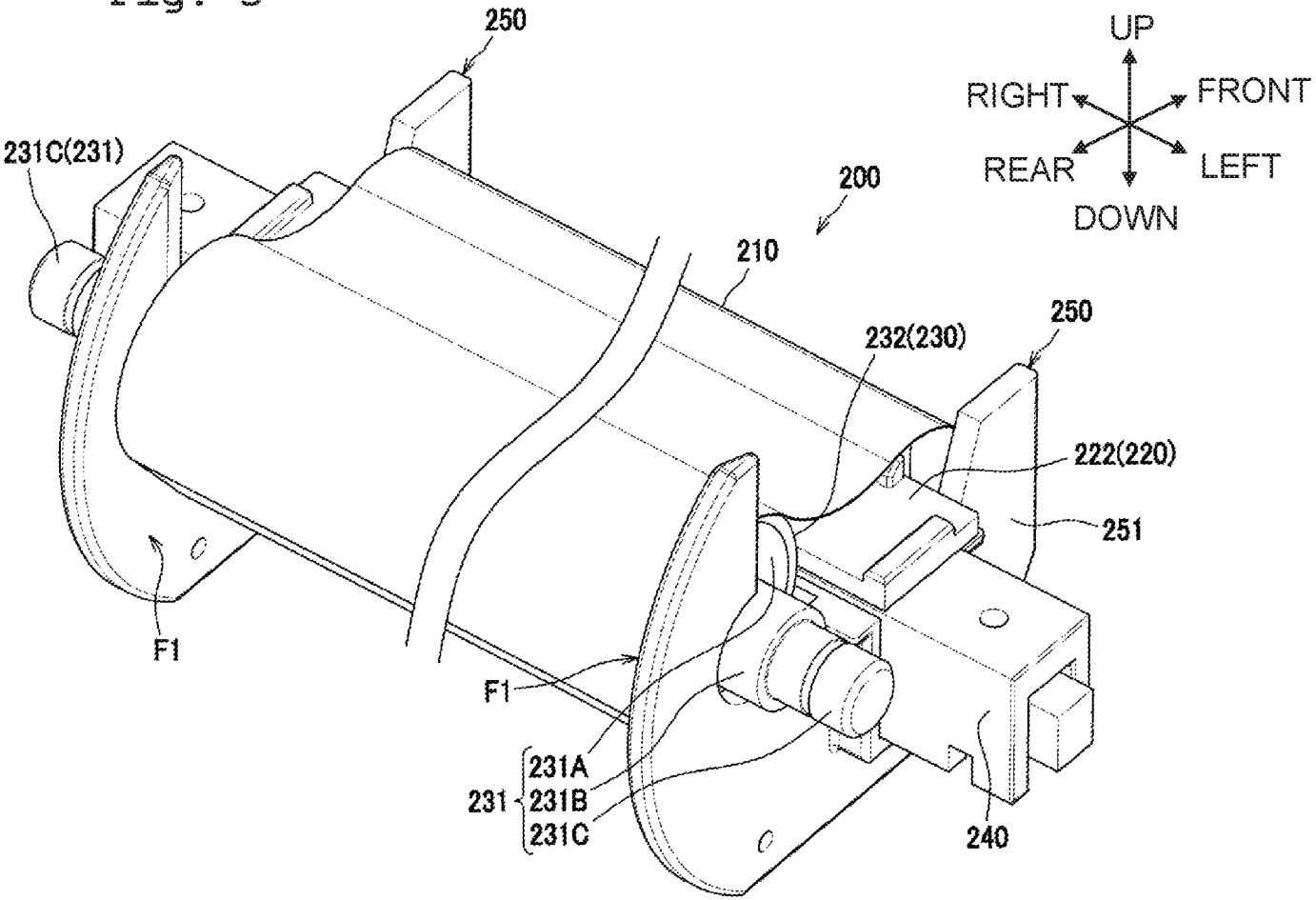
FIG. 3 is a perspective view depicting a pressure unit.

As depicted in FIG. 3, end portions of the shaft part 231 project from the end surfaces of the roller part 232, respectively. Specifically, the shaft part 231 has a columnar-shaped part 231A in which the roller part 232 sheathes the outer circumferential surface of the columnar-shaped part 231A; two columnar-shaped parts 231B provided on the end surfaces of the columnar-shaped part 231A, respectively; and two columnar-shaped parts 231C provided on the forward end surfaces of the columnar-shaped part 231B, respectively. The respective columnar-shaped parts 231A, 231B and 231C are arranged coaxially. The columnar-shaped parts 231B each have a diameter smaller than that of the columnar-shaped part 231A, and project from the end surfaces of the columnar-shaped part 231A, respectively. The columnar-shaped parts 231C each have a diameter smaller than that of one of the columnar-shaped parts 231B, and project from the end surfaces of the columnar-shaped parts 231B, respectively. A groove (not assigned with a reference numeral) along the outer circumferential surface of each of the columnar-shaped parts 231C is formed in a substantially central portion in the left-right direction of each of the columnar-shaped parts 231C.

The lateral guide 250 is a guide having a guide surface F1 which makes contact with an end (lateral end) of the endless belt 210, and is provided as two lateral guides 250 on the both sides, respectively, in the left-right direction of the endless belt 210. The shaft part 231 of the pressing roller 230, the end portions of the holder 222 of the pressing pad 220 and the end portions of the supporting rod 240 are projected to the outer side in the left-right direction of the lateral guides 250, respectively (specifically, plate-shaped sections 251 to be described later on).

Figure 4:
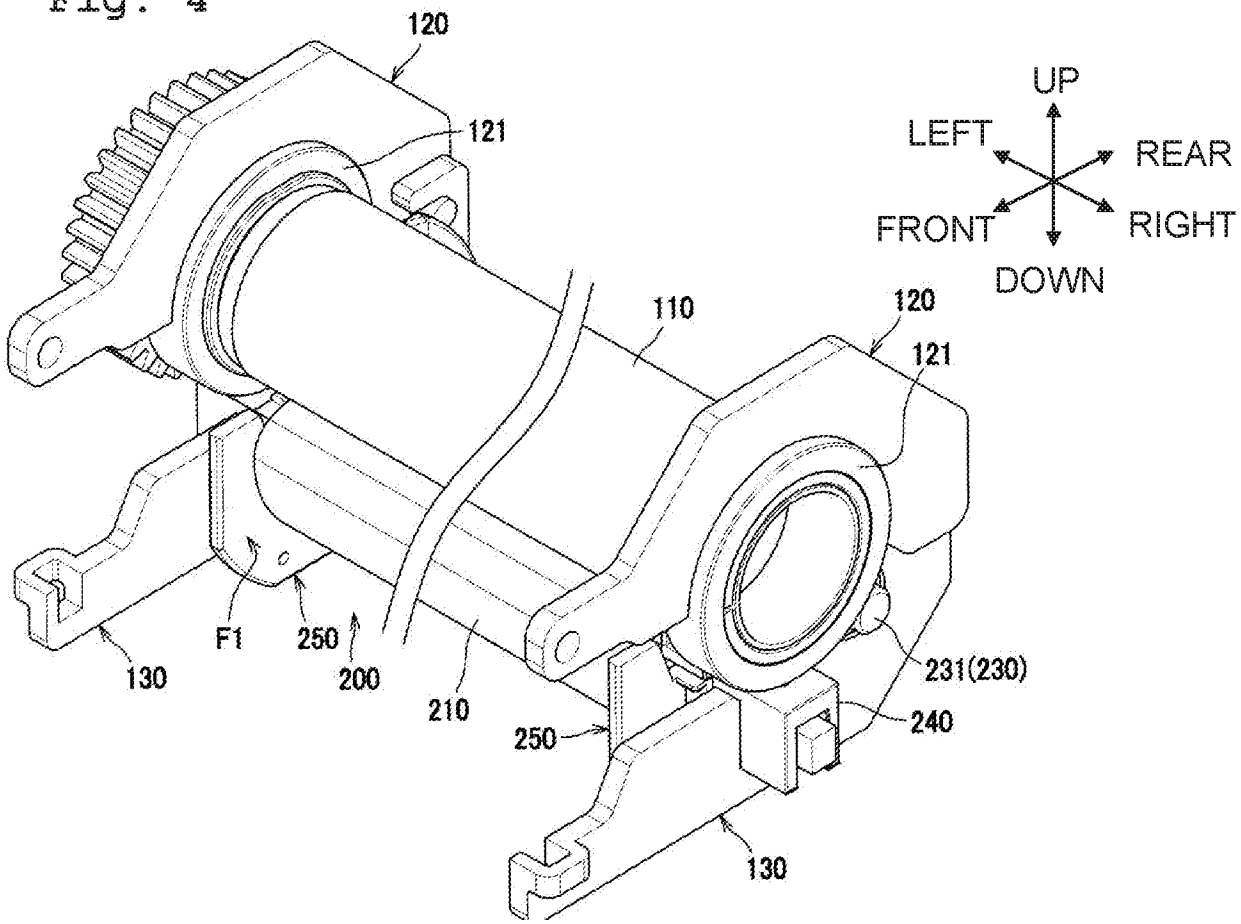
FIG. 4 is a perspective view depicting the pressure unit, a supporting arm and a pressing arm.
Figure 8:
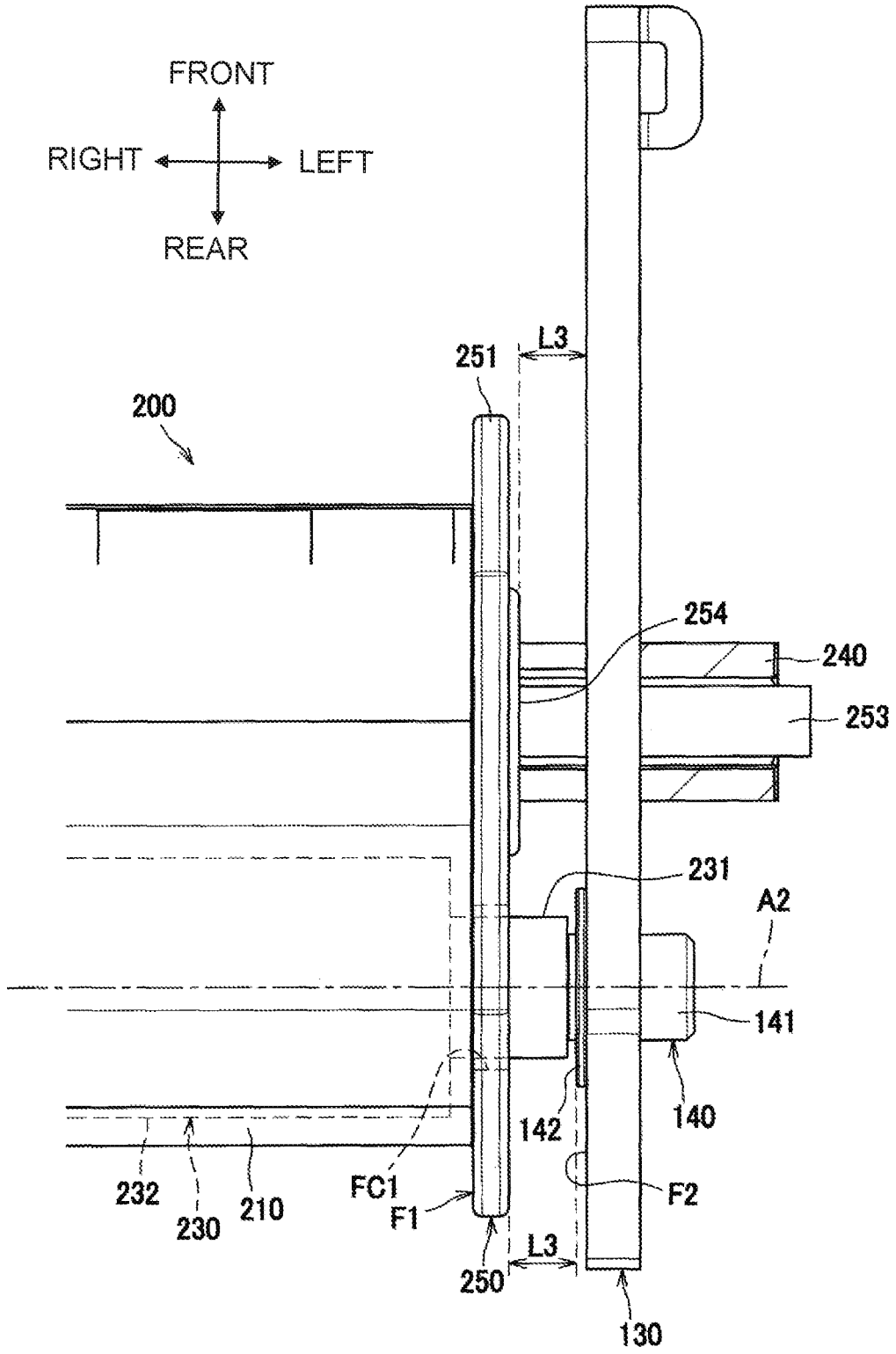
FIG. 8 is a plane view depicting the pressure unit and the pressing arm as seen from the upper side thereof.

Further, the shaft part 231 and the end portions of the supporting rod 240 which are projected form the lateral guides 250 are supported by a pressing arm 130 as an example of a supporting member, as depicted in FIG. 4. With this, as depicted in FIG. 8, the guide surface F1 of each of the lateral guides 250 is arranged between the pressing arm 130 and the roller part 232 on an axial line parallel to the rotation axis A2 of the pressing roller 230.

As depicted in FIG. 4, each of the end portions of the heating roller 110 is supported by a supporting arm 120 via a bearing 121. The supporting arm 120 is a plate-shaped member formed, for example, of a metal, and is provided as two supporting arms 120 arranged on the both sides in the left-right direction of the heating roller 110, respectively. The pressing arm 130 is a plate-shaped member formed, for example, of a metal, and is provided as two pressing arms 130 arranged on the both sides in the left-right direction of the pressure unit 200, respectively.

A rear end portion of the supporting arm 120 and a rear end portion of the pressing arm 130 are pivotably (rotatably) connected to each other. A forward end portion of the supporting arm 120 and a forward end portion of the pressing arm 130 are urged to move closer to each other by a non-illustrated tensile spring. With this, a nip pressure is generated between the heating roller 110 and the pressure unit 200. Note that any one of the supporting arm 120 and the pressing arm 130 is fixed to a non-illustrated fixing frame.

Figure 5:
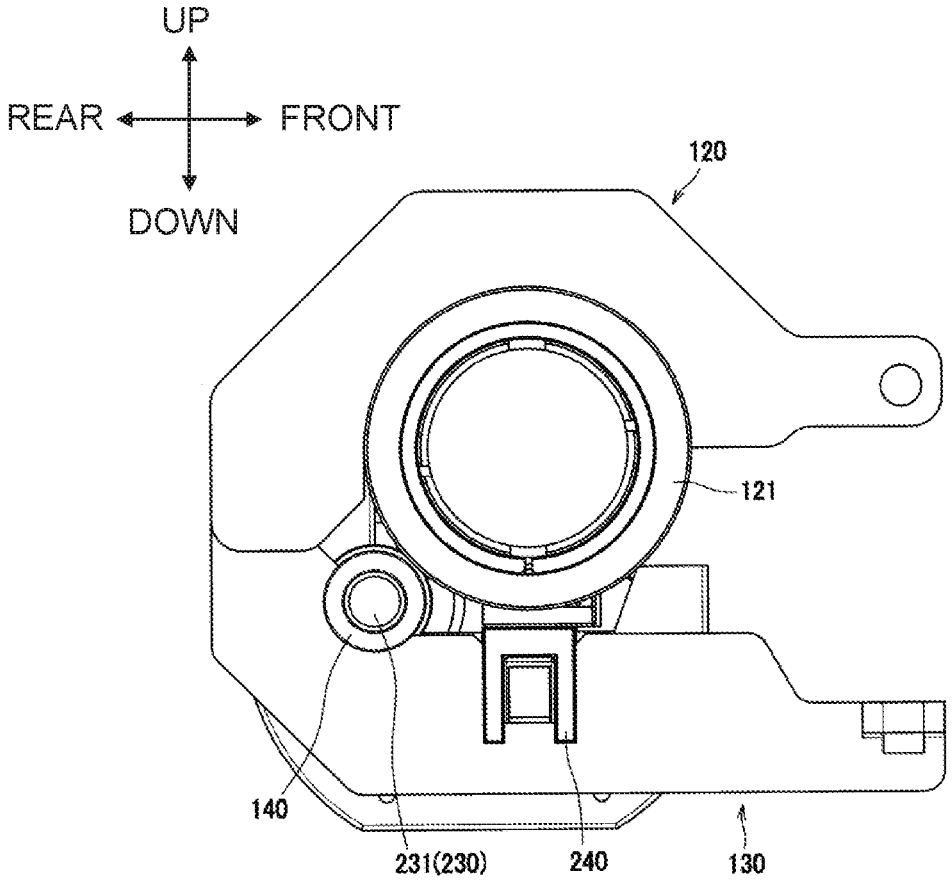
FIG. 5 is a side view depicting the pressure unit, the supporting arm and the pressing arm as seen from the left side thereof.

The bearing 121 is a member supporting each of the end portions of the heating roller 110 to be rotatable, and is fixed to the supporting arm 120. As depicted in FIG. 5, a bearing 140 rotatably supporting the shaft part 231 of the pressing roller 230 and the supporting rod 240 are fixed to the pressing arm 130. As depicted in FIG. 8, the bearing 140 has a cylindrical part 141 rotatably supporting the shaft part 231 of the pressing roller 230, and a flange part 142 extending outwardly in the radial direction from an end portion on the inner side in the left-right direction of the cylindrical part 141. The flange part 142 projects toward the roller part 232 from a surface F2, of the pressing arm 130, on the side of the roller part 232.

Figure 6A:
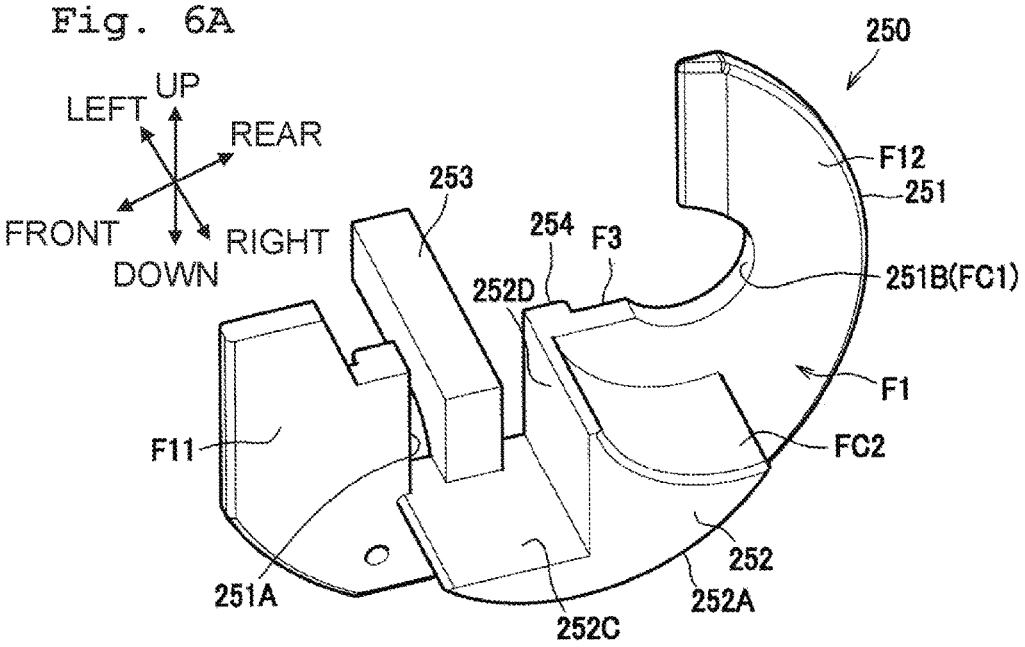
FIG. 6A is a perspective view depicting a lateral guide as seen from the inner side in the left-right direction.
Figure 6B:
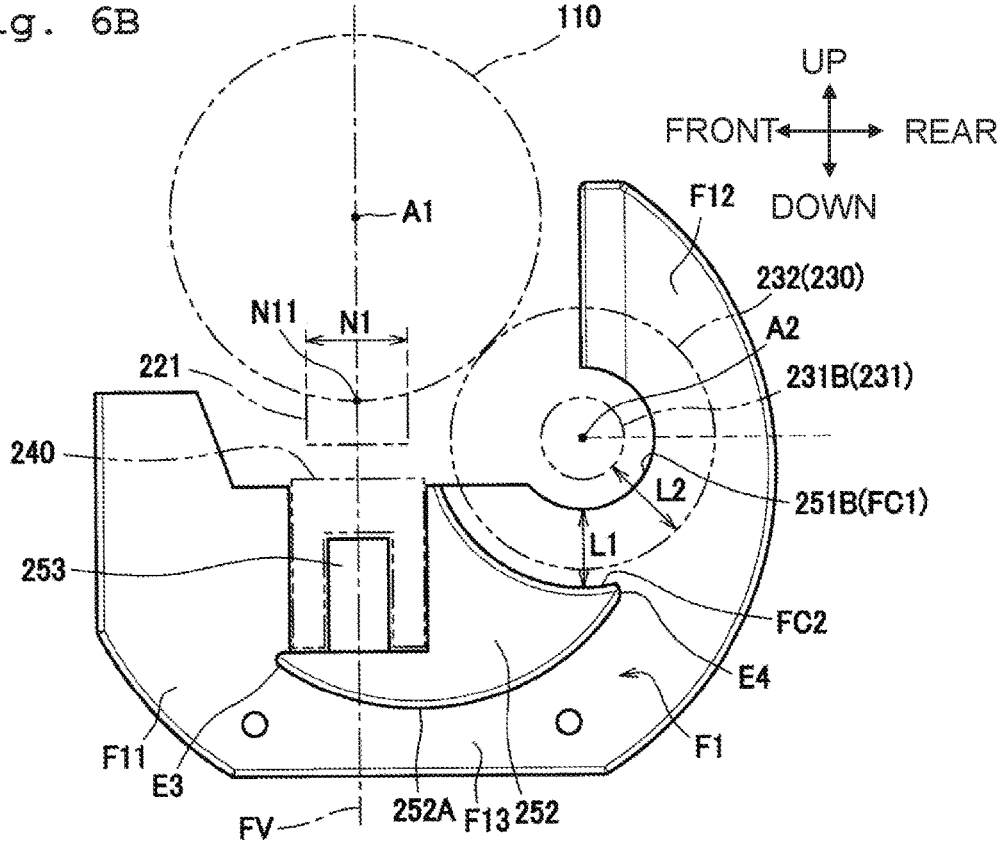
FIG. 6B is a side view of the lateral guide.

As depicted in FIGS. 6A and 6B, the lateral guide 250 has a plate-shaped part 251, an inner circumferential guide part 252 which guides the inner circumferential surface of the endless belt 210, an engaging part 253 which engages with the inner surface of the supporting rod 240, and a projection 254 which projects from an outer surface F3, of the plate-shaped part 251, on the outer side in the left-right direction.

The plate-shaped part 251 has an opening portion 251A configured to allow the end portion of the supporting rod 240 to pass from the inner side to the outer side in the left-right direction, and an opening portion 251B configured to allow the shaft part 231 of the pressing roller 230 to pass from the inner side to the outer side in the left-right direction. The opening portion 251A is a rectangular-shaped recessed portion along the outer diameter of the supporting rod 240, and penetrates (passes through) the plate-shaped part 251 in the left-right direction; the opening portion 251A is opened toward the heating roller 110.

The opening portion 251B is a circular arc-shaped recessed portion which has a shape along (conforming to) the outer circumferential surface of the columnar-shaped part 231B of the shaft part 231, and penetrates the plate-shaped part 251 in the left-right direction; the opening portion 251B is open toward the heating roller 110. The opening portion 251B has a circular-arc surface FC1 along the outer circumferential surface of the columnar-shaped part 231B. As depicted in FIGS. 7B and 8, the radius of the circular-arc surface FC1 is made to be smaller than the radius of the outer circumferential surface of the flange part 142 of the bearing 140.

As depicted in FIGS. 6A and 6B, a surface on the inner side in the left-right direction of the plate-shaped part 251 is the above-described guide surface F1. The guide surface F1 has a guide surface F11, a guide surface F12 and a guide surface F13.

The guide surface F11 is located on an opposite side to the pressing roller 230 with respect to a virtual plane FV including the center N11 of the nip area N1 and the center of rotation A1 of the heating roller 110. The guide surface F1 has a portion or part which is located above the center N11 of the nip area N1.

The guide surface F12 is located on a side of the pressing roller 230 with respect to the virtual plane FV and is located above the rotation axis A2 of the pressing roller 230. In other words, the guide surface F12 is located on the downstream side of the rotation axis A2 of the pressing roller 230 in the above-described direction D1 (direction from the lower side toward the upper side). Further, the guide surface F12 has a portion or part which is located above the center of rotation A1 of the heating roller 110.

The guide surface F13 connects the guide surface F11 and the guide surface F12 to each other. The guide surface F13 is arranged on a same plane as the guide surface F11 and the guide surface F12.

The inner circumferential guide part 252 has an inner circumferential guide surface 252A as an example of an inner circumferential guide surface which makes contact with the inner circumferential surface of the endless belt 120, a circular-arc surface FC2 along the outer circumferential surface of the roller part 232 of the pressing roller 230, and a guided surface 252C and a guided surface 252D which are capable of making contact with the outer surface of the supporting rod 240. The circumferential guide surface 252A is located at a position below the pressing roller 230. As depicted in FIG. 2, an end portion E3 which is an end portion, of the inner circumferential guide surface 252A, on the downstream side in the rotating direction of the endless belt 210 is located at a position in front of (on the front side of) the supporting rod 240 and behind (on the rear side of) the end portion E2 of the inner circumferential guide surface 261. Further, the end portion E3 is located at a position below the supporting rod 240.

An end portion E4 which is an end portion, of the inner circumferential guide surface 252A, on the upstream side in the rotating direction of the endless belt 210 is located at a position behind (on the rear side of) the rotation axis A2 of the pressing roller 230. Further, in the up-down direction, the end portion E4 is located at a position between the pressing roller 230 and the lower surface of the supporting rod 240.

The inner circumferential guide part 252 is supported by the endless belt 210 from therebelow. With this, the lateral guide 250 is supported by the endless belt 210.

As depicted in FIGS. 6A and 6B, the radius of the circular-arc surface FC2 is made to be greater than the radius of the roller part 232 of the pressing roller 230. Further, in the radial direction of the pressing roller 230, a distance L1 from the circular-arc surface FC1 to the circular-arc surface FC2 is smaller than a distance L2 from the outer circumferential surface of the columnar-shaped part 231B of the shaft part 231 of the pressing roller 230 to the outer circumferential surface of the roller part 232.

The guided surface 252C is a surface on a same plane with the lower surface of the opening portion 251A of the plate-shaped part 251, and extends toward the inner side in the left-right direction from an end portion on the inner side in the left-right direction of the lower surface of the opening portion 251A. A front end portion of the guided surface 252C is located in front, to a little extent, of the opening portion 251A.

The guided surface 252D is a surface on a same plane with the rear surface of the opening portion 251A of the plate-shaped part 251, and extends toward the inner side in the left-right direction from an end portion on the inner side in the left-right direction of the rear surface of the opening portion 251A.

The engaging part 253 extends upwardly from the lower surface of the opening portion 251A of the plate-shaped part 251, then extends toward the outer side in the left-right direction. The engaging part 253 is arranged in the inside of the supporting rod 240 and is made to be capable of making contact with the inner surface of the supporting rod 240.

Figure 7A:
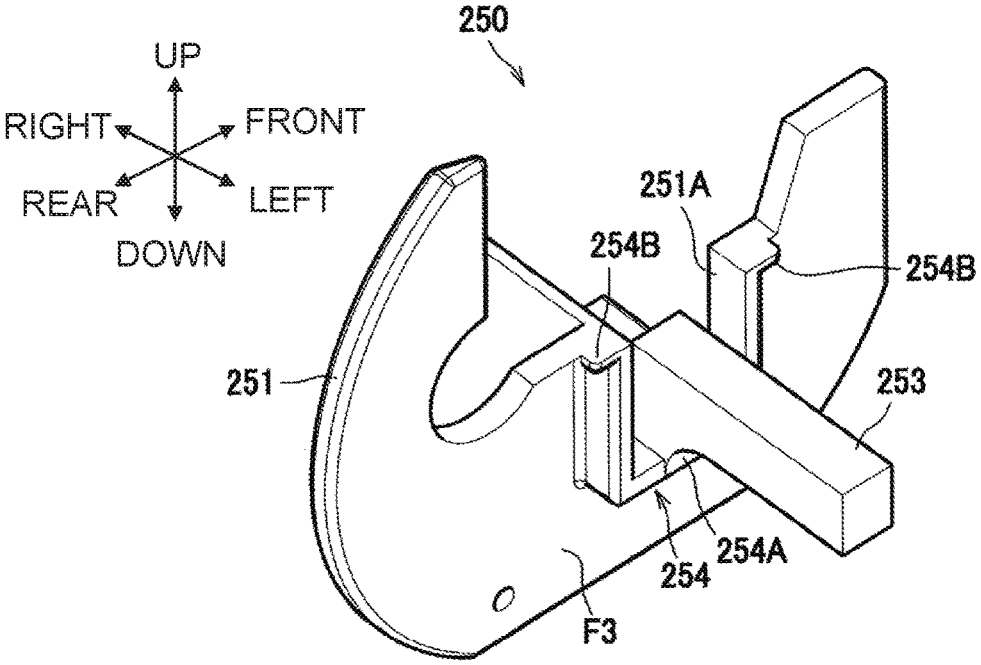
FIG. 7A is a perspective view depicting the lateral guide as seen from the outer side in the left-right direction.
Figure 7B:
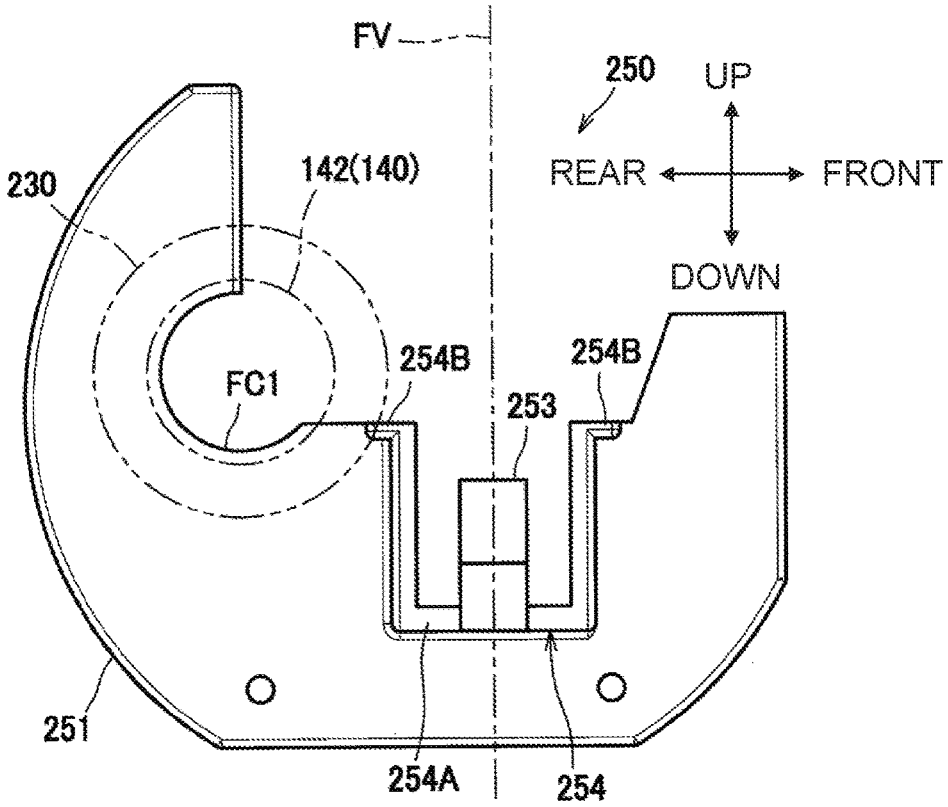
FIG. 7B is a side view of the lateral guide.

As depicted in FIGS. 7A and 7B, the projection 254 has an area 254A formed along the edge of the opening portion 251A of the plate-shaped part 251 and has a cross section which is U-shaped, and two areas 254B extending from upper end portions, respectively, of the area 254A outwardly in the front-rear direction. A part or portion of the projection 254 is located on the opposite side to the pressing roller 230 with respect to the virtual plane FV. In other words, the part or portion of the projection 254 is located on the opposite side to the bearing 140 with respect to the virtual plane FV.

As depicted in FIG. 8, the projection 254 projects from the plate-shaped part 251 toward the pressing arm 130. In the second direction along the rotation axis A2 of the pressing roller 230, namely in the left-right direction, a distance L3 from the bearing 140 up to the lateral guide 250 is made to be same with the distance L3 from the projection 254 up to the pressing arm 130.

The lateral guide 250 which is configured as described above is made to be movable with respect to the supporting rod 240 in the second direction, namely the left-right direction, owing to the contact made by the projection 254, the opening portion 251A, the guided surface 252C and the guided surface 252D with the outer surface of the supporting rod 240, and the contact made by the engaging part 253 with the inner surface of the supporting rod 240.

Further, as depicted in FIG. 8, the engaging part 253 of the lateral guide 250 projects further outwardly in the left-right direction than the supporting rod 240, under a condition that the lateral guide 250 is located at a position on the innermost side in the left-right direction. Furthermore, the end portion of the engaging part 253 projecting in such a manner from (more than) the supporting rod 240 is urged toward the inner side in the left-right direction by a non-illustrated spring.

Next, the functions and effects of the lateral guide 250 will be explained. As depicted in FIG. 2, in a case that the fuser 100 is driven, the heating roller 110 rotates clockwise as depicted in the drawing and the endless belt 210 rotates counterclockwise as depicted in the drawing. In this situation, the guide surface F11, the guide surface F12 and the guide surface F13 which are arranged on the same plane are disposed on one member, namely the lateral guide 250, the positions of the respective guide surfaces F11, F12 and F13 are not shifted or deviated relative to one another. Accordingly, it is possible to satisfactorily suppress any meandering of the endless belt 210.

Further, since the guide surface F12 is located above the rotation axis A2 of the pressing roller 230, it is possible to satisfactorily suppress the meandering of the endless belt 210 even in such a fuser 100 wherein the endless belt 210 is carved along the heating roller 110.

Furthermore, by providing the guide surface F13 which connects or links the guide surface F11 and the guide surface F12 to each other, it is possible to guide a part or portion, of the end portion of the endless belt 210, corresponding to not less than half the entire length of the endless belt 210 with the respective guide surfaces F11 to F13. Accordingly, it is possible to suppress the meandering of the endless belt 210 more satisfactorily, as compared with a configuration wherein, for example, the guide surface F13 is not provided.

In a case that the endless belt 210 is moved from the center toward the one side in the left-right direction, the lateral guide 250 on the one side moves along the supporting rod 240, together with the endless belt 210, outwardly in the left-right direction. Namely, in a case that the lateral end of the endless belt 210 makes contact with the lateral guide 250, the lateral guide 250 can move to escape form this contact, thereby making it possible to prevent the lateral end of the endless belt 210 from making contact with the lateral guide 250 strongly and to suppress any damage to the lateral end of the endless belt 210.

Further, in a case that the lateral guide 250 is moved in the left-right direction, the lateral guide 250 is moved while making contact with the outer surface of the supporting rod 240. Here, in a case that the supporting rod 240 has a cross section which is U-shaped, the accuracy of dimension is more precise in the outer surface than in the inner surface of the supporting rod 240. Accordingly, by allowing the lateral guide 250 to make contact with the outer surface of the supporting rod 240, it is possible to move the lateral guide 250 smoothly.

Furthermore, in a case that the lateral guide 250 is moved to the outermost side in the left-right direction, the plate-shaped part 251 of the lateral guide 250 makes contact with the bearing 140 substantially at the same time as the projection 254 of the lateral guide 250 makes contact with the pressing arm 130, as depicted in FIG. 8. With this, in a case that the lateral guide 250 makes contact with the pressing arm 130, it is possible to suppress any inclination of the lateral guide 250.

Moreover, in the embodiment, by arranging the part or portion of the projection 254 on the opposite side to the bearing 140 with respect to the virtual plane FV, it is possible to allow two parts or portions, of the lateral guide 250, which are apart from each other in the front-rear direction to make contact with the pressing arm 130. Accordingly, it is possible to suppress any inclination of the lateral guide 250 more satisfactorily.

As described above, according to the present embodiment, it is possible to achieve the following effects, in addition to the above-described effects.

By allowing the distance L1 from the circular-arc surface FC1 to the circular-arc surface FC2 to be smaller than the distance L2 from the outer circumferential surface of the columnar-shaped part 231B of the shaft part 231 to the outer circumferential surface of the roller part 232. Accordingly, when the fuser 100 is assembled, it is possible to receive the outer circumferential surface of the roller 232 with the circular-arc surface FC2 of the lateral guide 250. This consequently makes it possible to assemble the pressing roller 230 to the pressing arm 130 in a state that the position of the pressing roller 230 is defined in the inside of the endless belt 210, thereby making it possible to improve the efficiency in the assembly.

Since the radius of the circular-arc surface FC1 is made to be smaller than the radius of the outer circumferential surface of the flange part 142 of the bearing 140, it is possible to regulate, by the bearing 140, the movement of the lateral guide 250 outwardly in the left-right direction.

Since the lateral guide 250 is supported by the endless belt 210, it is possible to maintain the positional relationship between the endless belt 210 and the lateral guide 250 to be substantially constant, even when the state of the nip pressure is switched, thereby making it possible to guide the endless belt 210 satisfactorily with the lateral guide 250.

Since the lateral guide 250 has the inner circumferential guide surface 252A, it is possible to reduce the number of parts or components, as compared with, for example, a configuration wherein a member having the inner circumferential guide surface 252A is provided separately from the lateral guide 250.

Note that the present teaching is not limited to or restricted by the above-described embodiment, and can be used in a variety of kinds of form or aspect, as exemplified below.

In the embodiment, although the projection 254 is provided on the lateral guide 250, the present teaching is not limited to this; for example, a projection projecting toward the lateral guide may be provided on the pressing arm. Note that in such a case that the bearing and the projection are provided on the pressing arm, it is possible, for example, that an end surface of the bearing and an end surface of the projection are arranged on a same plane, and that a surface of the lateral guide making contact with the bearing and a surface of the lateral guide making contact with the projection are arranged on a same plane.

In the embodiment, although the part or portion of the projection 254 is arranged on the opposite side to the bearing 140 with respect to the virtual plane FV, the present teaching is not limited to this. It is allowable that at least a part or portion of the projection is arranged on the opposite side to the bearing with respect to the virtual plane. Namely, for example, it is also allowable that the entirety of the projection is arranged on the opposite side to the bearing with respect to the virtual plane.

In the embodiment, although the heating roller 110 is described as an example of the cylindrical member, the present teaching is not limited to this. It is also allowable that the cylindrical member is, for example, a pressing roller. Note that in this case, it is also allowable, for example, to provide a heater configured to heat the endless belt on the inside or on the outside of the endless belt.

In the embodiment, although the pressing pad 220 is described as an example of the pressing member, the present teaching is not limited to this. It is also allowable that the pressing member is, for example, a pressing roller which is rotatable.

In the embodiment, although the pressing arm 130 is described as an example of the supporting member, the present teaching is not limited to this. It is also allowable that the supporting member is, for example, a fixing frame.

Further, it is also allowable to combine the respective parts or components explained in the above-described embodiment and modifications in any way to practice the present teaching.

What is claimed is:

1. A fuser comprising:

a cylindrical member;

an endless belt including an outer circumferential surface contacting the cylindrical member, an inner circumferential surface being a reverse surface of the outer circumferential surface, and a lateral edge being an edge of the endless belt in a width direction of the endless belt;

a pressing member contacting the inner circumferential surface of the endless belt and sandwiching the endless belt together with the cylindrical member so as to form a first nip area;

a pressing roller contacting the inner circumferential surface of the endless belt and sandwiching the endless belt together with the cylindrical member so as to form a second nip area; and a lateral guide including a guide surface contacting the lateral edge of the endless belt, wherein a part of an outer circumferential surface of the pressing roller is located downstream of the second nip area in a first direction, the first direction being perpendicular to a rotation axis of the pressing roller and directing from a center of the first nip area toward a center of rotation of the cylindrical member, wherein the guide surface includes a first guide surface and a second guide surface, the first guide surface being located such that the pressing member is located between the pressing roller and the first guide surface in a predetermined direction, the predetermined direction being perpendicular to the rotational axis and the first direction, and the second guide surface being located such that the pressing member is located between the second guide surface and the first guide surface in the predetermined direction, the second guide surface being located downstream of the rotation axis of the pressing roller in the first direction, the second guide surface contacting a downstream portion of the lateral edge of the endless belt, the downstream portion of the lateral edge being located downstream of the second nip area in the first direction, and the second guide surface being arranged on a same plane as the first guide surface, and wherein the lateral guide defines a gap between the first guide surface and the second guide surface in the predetermined direction, and portions of the endless belt at the first and second nip areas are located within the gap in the predetermined direction such that the lateral edge of the portions of the endless belt do not contact both the first guide surface and the second guide surface.

2. The fuser according to claim 1, wherein the guide surface includes a third guide surface connecting the first guide surface and the second guide surface, the third guide surface being arranged on the same plane as the first and second guide surfaces.

3. The fuser according to claim 1, wherein the pressing roller includes: a roller portion contacting the inner circumferential surface of the endless belt, and a shaft projecting from an end of the roller portion, wherein the fuser further comprises a supporting member supporting the shaft of the pressing roller and the pressing member, and wherein the guide surface is arranged between the supporting member and the roller portion in an axial direction parallel to the rotation axis of the pressing roller.

4. The fuser according to claim 3, wherein the lateral guide includes:

a first circular-arc surface along an outer circumferential surface of the shaft; and a second circular-arc surface along an outer circumferential surface of the roller portion, and wherein in a radial direction of the pressing roller, a distance from the first circular-arc surface to the second circular-arc surface is smaller than a distance from the outer circumferential surface of the shaft to the outer circumferential surface of the roller portion.

5. The fuser according to claim 4, further comprising a bearing provided on the supporting member and supporting the shaft, wherein the bearing projects toward the roller portion from a surface, of the supporting member, facing the roller portion; and a radius of the first circular-arc surface is smaller than a radius of an outer circumferential surface of the bearing.

6. The fuser according to claim 5, wherein the lateral guide includes a projection projecting toward the supporting member, and in a second direction along the rotation axis, a distance from a surface, of the bearing, facing the lateral guide to a surface, of the lateral guide, facing the bearing is equal to a distance from a surface, of the projection, facing the supporting member to a surface, of the supporting member, facing the lateral guide.

7. The fuser according to claim 6, wherein the center of the first nip area is located between the bearing and at least a part of the projection in the predetermined direction.

8. The fuser according to claim 1, further comprising a stay supporting the pressing member at an inner space formed by the endless belt, wherein the lateral guide contacts an outer surface of the stay.

9. The fuser according to claim 8, wherein the stay has a U-shaped cross section, and wherein the lateral guide includes an engaging part engaging an inner surface of the stay.

10. The fuser according to claim 8, wherein the lateral guide is movable, with respect to the stay, in a second direction along the rotation axis of the pressing roller.

11. The fuser according to claim 1, wherein the lateral guide is supported by the endless belt.

12. The fuser according to claim 1, wherein the lateral guide includes an inner circumferential guide surface contacting the inner circumferential surface of the endless belt.

13. The fuser according to claim 1, wherein the pressing member includes a pad.

14. The fuser according to claim 13, wherein the pad is formed of rubber.

15. The fuser according to claim 1, wherein the pressing roller is disposed at a downstream side of the pressing member in a movement direction of the endless belt at the first nip area.

16. The fuser according to claim 1, wherein the cylindrical member includes a tube and a heater disposed in the tube.

* * * * *